US006041713A

United States Patent [19]

Altenau et al.

[11] Patent Number: 6,041,713

[45] Date of Patent: Mar. 28, 2000

[54] PRACTICE PROJECTILE

[75] Inventors: Ernst-Wilhelm Altenau, Duisburg; Günter Sikorski, Düsseldorf; Werner Reczko, Unterlüss, all of Germany

[73] Assignee: Rheinmetall W & M GmbH, Ratingen, Germany

[21] Appl. No.: 09/076,732

[22] Filed: May 13, 1998

[30] Foreign Application Priority Data

May 30, 1997 [DE] Germany ..... 197 22 698

[51] Int. Cl.[7] ..... F42B 8/12

[52] U.S. Cl. ..... 102/498; 102/334; 102/513

[58] Field of Search ..... 102/334, 382, 102/389, 395, 444, 445, 473, 478, 498, 499, 500, 513, 529

[56] References Cited

U.S. PATENT DOCUMENTS

| | | | |
|---|---|---|---|
| 382,223 | 5/1888 | Graydon | 102/478 |
| 1,963,451 | 6/1934 | Yurgin et al. | 102/395 |
| 3,289,588 | 12/1966 | Hitchens et al. | 102/513 |
| 4,446,794 | 5/1984 | Simmons | 102/513 |

FOREIGN PATENT DOCUMENTS

| | | | |
|---|---|---|---|
| 493294 | 8/1919 | France | 102/478 |
| 745599 | 5/1933 | France | 102/395 |
| 35 31 688 | 3/1987 | Germany . | |
| 35 41 399 | 5/1987 | Germany . | |
| 196 42 679 | 4/1998 | Germany . | |

OTHER PUBLICATIONS

Rudolf Meyer, *Explosives*, Verlag Chemie, Weinheim, New York, pp. 51, 150–152, 201, 292–294, 1977.

*Primary Examiner*—Harold J. Tudor
*Attorney, Agent, or Firm*—Venable; Gabor J. Kelemen

[57] ABSTRACT

A practice projectile includes a projectile jacket having a frontal end, a rearward end including a base, a length and a longitudinal axis; a fuze igniting on impact and being disposed in the projectile jacket; a component defining an axial tubular cavity extending throughout a preponderant portion of jacket length; a plurality of axially spaced explosive charges disposed in the cavity; and a transfer charge disposed between adjoining explosive charges for coupling the explosive charges to one another.

13 Claims, 1 Drawing Sheet

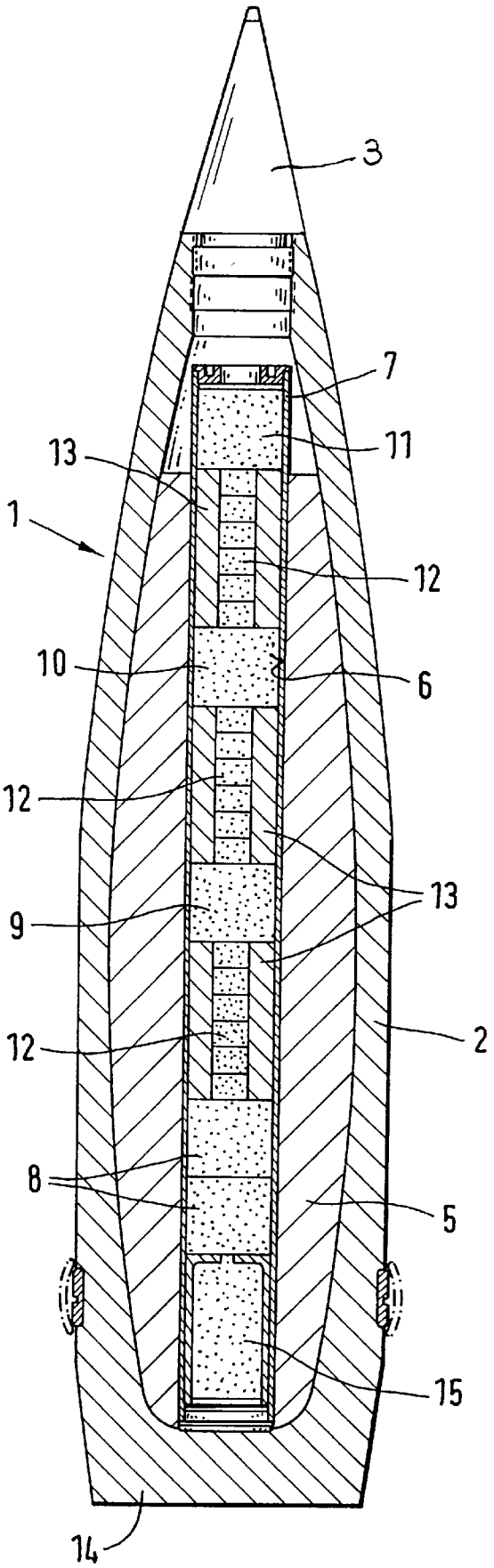
3
7
11
13
1
12
10
6
12
13
9
2
12
8
5
15
14

PRACTICE PROJECTILE

BACKGROUND OF THE INVENTION

This invention relates to a practice projectile having a projectile jacket and a fuze which fires on impact.

A conventional practice projectile, particularly for artillery weapons is described in German Offenlegungsschrift (application published without examination) 35 31 688. In the practice projectile described therein, the base of the projectile is blown off by a shaped charge when the target is hit, and, as a result, from the opening obtained in this manner smoke escapes which is generated by a signaling charge for a better visual identification of the point of impact.

It is a disadvantage of the above-outlined known practice projectile that, among others, the manufacturing costs are relatively high because of the shaped charge and further, upon activation of the shaped charge a flash is generated which is excessively powerful as compared to live explosive projectiles. Further, the dismantling of the projectile parts also involves substantial expense.

SUMMARY OF THE INVENTION

It is an object of the invention to provide an improved practice projectile, particularly for artillery weapons which, compared to known practice projectiles, may be manufactured in a more economical manner and which, upon impacting on the target, generates only a slight noise and further, its explosion has a well-recognizable signature.

This object and others to become apparent as the specification progresses, are accomplished by the invention, according to which, briefly stated, the practice projectile includes a projectile jacket having a frontal end, a rearward end including a base, a length and a longitudinal axis; a fuze igniting on impact; a component defining an axial tubular cavity extending throughout a preponderant portion of jacket length; a plurality of axially spaced explosive charges disposed in the cavity; and a transfer charge disposed between adjoining explosive charges for coupling the explosive charges to one another.

The invention is essentially based on the principle to provide an axial tubular cavity in the practice projectile. The cavity may be defined by a metal or plastic inner wall face and is surrounded by an inert mass. Or, the tubular cavity may be constituted by an axial channel formed in the inert mass. The tubular cavity accommodates spaced explosive (working) charges coupled to one another by interposed transfer charges.

The practice projectile according to the invention has several advantages:

By arranging the working charges spaced from one another, the working charges exploding in the target area split the practice projectile into relatively large fragments which may be dismantled in a simple manner since the explosive pressure entirely separates the inert material from the projectile jacket and the toxicologically harmless inert mass may remain in the target area.

As a departure from the practice projectile described in the earlier-noted German Offenlegungsschrift 35 31 688, no dangerous, rearwardly hurtling fragments will result from the explosion of the practice projectile according to the invention, and therefore only a small safety zone is required.

The explosion noise is substantially reduced by virtue of the small quantity of explosives as compared to live projectiles.

The signaling effect (flash and smoke) of practice projectiles according to the invention is essentially comparable to corresponding live projectiles.

BRIEF DESCRIPTION OF THE DRAWING

The sole FIGURE is an axial sectional view of a preferred embodiment of the invention.

DESCRIPTION OF THE PREFERRED EMBODIMENT

The practice projectile according to the invention generally designated at 1 has a projectile jacket 2 made of steel and a fuze 3 igniting on impact and screwed into the front end of the jacket 2. In storage or transport of the practice projectile, instead of the fuze 3, the front end of the jacket 2 carries a conventional, screwed-in hoisting plug (not shown) provided with an eyelet; the hoisting plug is replaced by the fuze 3 usually in the field just before use. The projectile jacket 2 accommodates a body 5 made of a toxicologically harmless inert mass, provided with a central axial channel 6 in which a relatively thin-walled metal or plastic tube 7 is inserted. The channel 6 and the tube 7 arranged coaxially therein extend through a preponderant portion of the projectile length.

According to the invention, in the tube 7 axially mutually spaced explosive charges 8, 9, 10 and 11 are disposed which are connected to one another by means of interposed transfer charges 12. The transfer charges 12 are accommodated inside inert bodies (sleeves) 13 which also serve to define the distance between adjoining explosive charges 8–11.

The number and the force of the explosive charges 8–11 is so selected that the disintegration of the projectile jacket 2 occurs in the desired manner (relatively large fragments) and the signature of the exploding practice projectile seen by the observer has a predetermined configuration.

To ensure a reliable ignition of the explosive column formed of the alternatingly disposed explosive charges and transfer charges, it has been found advantageous to provide that the explosive charge 11 which adjoins the impact fuze 3 and the transfer charges 12 are preponderantly of an explosive which contains hexogen or octogen. The other explosive charges 8, 9 and 10 may be trinitrotoluol (TNT) or composition B (Comp B).

It has further been found advantageous to arrange a signature-improving signaling charge 15 between the projectile base 14 of the practice projectile 1 and the explosive charge 8 which is closest to the projectile base 14. The signaling charge 15 is a suitable pyrotechnical mass for improving the smoke and/or flash effect. The signaling charge 15 may also be a flowable inert mass (for example, flame soot) solely for improving the smoke effect.

It is to be understood that the invention is not limited to the described embodiment. Thus, for example, the explosive charges and transfer charges may also be arranged directly in the central channel 6 of the inert mass 5. The use of the separate tube 7, however, has the significant advantage that the entire charge assembly, formed of the explosive charges, the transfer charges and the signaling charge may be manufactured as a separate, prefabricated unit and after the removal of the hoisting plug 3 the charge assembly may be inserted into the frontal opening of the projectile jacket 2. The inert mass 5 is introduced into the projectile jacket 2 either before inserting the tube 7 or, as the case may be, before inserting the prefabricated charge assembly or it may be subsequently poured in as a suitable flowable or bulk material.

It will be understood that the above description of the present invention is susceptible to various modifications, changes and adaptations, and the same are intended to be comprehended within the meaning and range of equivalents of the appended claims.

What is claimed is:

1. A practice projectile comprising (a) a projectile jacket having a length, a longitudinal axis, a frontal end, and a rearward end including a base;

(b) a fuze igniting on impact and carried by said projectile jacket;

(c) an inert body accommodated in said projectile jacket;

(d) an axial channel provided in said inert body; said inert body and said axial channel extending throughout a major portion of said length of said jacket;

(e) a plurality of axially spaced explosive charges disposed in said channel; and (f) a transfer charge disposed between adjoining said explosive charges for transferring ignition from one of said explosive charge to the adjoining said explosive charge.

2. The practice projectile as defined in claim 1, wherein said impact fuze is disposed in said jacket at the frontal end thereof.

3. The practice projectile as defined in claim 1, wherein one of said explosive charges is closest to said base; further comprising a signaling charge disposed in said channel between said base and said one explosive charge.

4. The practice projectile as defined in claim 3, wherein said signaling charge is a pyrotechnical charge.

5. The practice projectile as defined in claim 3, wherein said signaling charge is flame soot.

6. The practice projectile as defined in claim 1, wherein at least part of said explosive charges is a substance selected from the group consisting of TNT and Comp B.

7. The practice projectile as defined in claim 1, wherein one of said explosive charges adjoins said fuze and is an explosive containing a substance selected from the group consisting of hexogen and octogen.

8. The practice projectile as defined in claim 1, wherein said transfer charge is an explosive containing a substance selected from the group consisting of hexogen and octogen.

9. The practice projectile as defined in claim 1, further comprising a metal tube disposed axially in said channel; said metal tube surrounding said explosive and transfer charges.

10. The practice projectile as defined in claim 1, further comprising a plastic tube disposed axially in said channel; said plastic tube surrounding said explosive and transfer charges.

11. The practice projectile as defined in claim 1, wherein said transfer charge extends solely between said adjoining explosive charges and determines an axial spacing therebetween.

12. The practice projectile as defined in claim 1, further comprising an inert spacer member disposed in said channel between said adjoining explosive charges.

13. The practice projectile as defined in claim 12, wherein said inert spacer member is tubular and surrounds said transfer charge.

* * * * *